US007260229B2

(12) United States Patent
Hlibowicki

(10) Patent No.: US 7,260,229 B2
(45) Date of Patent: Aug. 21, 2007

(54) POSITION SENSOR FOR A LOUDSPEAKER

(75) Inventor: Stefan R. Hlibowicki, Toronto (CA)

(73) Assignee: Audio Products International Corp., Scarborough, Ontario (CA)

( * ) Notice: Subject to any disclaimer, the term of this patent is extended or adjusted under 35 U.S.C. 154(b) by 882 days.

(21) Appl. No.: 10/270,733

(22) Filed: Oct. 16, 2002

(65) Prior Publication Data

US 2003/0086576 A1 May 8, 2003

Related U.S. Application Data

(60) Provisional application No. 60/329,350, filed on Oct. 16, 2001.

(51) Int. Cl.
*H04R 3/00* (2006.01)

(52) U.S. Cl. ..... 381/96; 381/96; 381/401; 381/396; 335/231; 336/200

(58) Field of Classification Search ..... 381/96, 381/107, 401, 396; 335/231, 223; 336/200
See application file for complete search history.

(56) References Cited

U.S. PATENT DOCUMENTS 3,047,681 A 7/1962 Winker
3,647,969 A 3/1972 Korn (Continued)

FOREIGN PATENT DOCUMENTS

EP 0134092 3/1985

OTHER PUBLICATIONS

Wolfgang Klippel, The Mirror Filter—A New Basis for Reducing Nonlinear Distortion and Equalizing Response in Woofer Systems, J. Audio Eng. Soc., Sep. 1992, 675-691, vol. 40.

(Continued)

*Primary Examiner*—Vivian Chin
*Assistant Examiner*—Con P. Tran
(74) *Attorney, Agent, or Firm*—Bereskin and Parr

(57) ABSTRACT

The invention relates to an improved electro-dynamic loudspeaker. The electro-dynamic loudspeaker comprises (a) a voice coil for generating an acoustic waveform, the voice coil being longitudinally movable from an initial rest position to generate the acoustic waveform; (b) a second element of the loudspeaker, the second element being stationary relative to the voice coil; (c) an inductance-affecting core mounted on the voice coil for movement therewith, the inductance-affecting core having a length and a variable inductance-affecting capacity; (d) at least one inductor adjoining the inductance-affecting core and mounted on the second element, the at least one inductor having an associated length shorter than the length of the conductor core such that only a variable portion of the inductance-affecting core adjoins the inductor, the variable portion having a variable average inductance-affecting capacity and a portion length substantially equal to the associated length of the at least one inductor; and, (e) a position sensor circuit connected to the at least one inductor for providing a variable signal based on the variable average inductance-affecting capacity of the variable portion of the inductance-affecting core adjoining the at least one inductor. The variable average inductance-affecting capacity of the variable portion varies with the degree of deflection of the voice coil relative to the second element to vary the variable signal.

23 Claims, 15 Drawing Sheets

U.S. PATENT DOCUMENTS 3,798,374 A 3/1974 Meyers
3,821,473 A 6/1974 Mullins
3,889,060 A 6/1975 Goto et al.
3,941,932 A 3/1976 D'Hoogh
4,176,305 A 11/1979 Cuno
4,180,706 A 12/1979 Bakgaard
4,207,430 A 6/1980 Harada et al.
4,229,618 A 10/1980 Gamble
4,243,839 A * 1/1981 Takahashi et al. ..... 381/96
4,256,923 A 3/1981 Meyers
4,276,443 A 6/1981 Meyers
4,395,588 A 7/1983 Franssen et al.
4,395,711 A * 7/1983 Ward ..... 340/870.31
4,488,012 A 12/1984 Matsuda et al.
4,550,430 A 10/1985 Meyers
4,573,189 A 2/1986 Hall
4,592,088 A 5/1986 Shimada
4,609,784 A 9/1986 Miller
4,709,391 A 11/1987 Kaizer et al.
4,727,584 A 2/1988 Hall
4,821,328 A 4/1989 Drozdowski
5,086,473 A 2/1992 Erath
5,181,251 A 1/1993 Schultheiss et al.
5,185,805 A 2/1993 Chiang
5,197,104 A 3/1993 Padi
5,408,533 A 4/1995 Reiffin
5,418,860 A 5/1995 Daniels
5,438,625 A 8/1995 Klippel
5,533,134 A 7/1996 Tokura et al.
5,542,001 A 7/1996 Reiffin
5,771,300 A 6/1998 Daniels
6,104,817 A 8/2000 Ding
6,404,319 B1 * 6/2002 Iida et al. ..... 336/200
6,694,037 B1 * 2/2004 Robinson et al. ..... 381/398

OTHER PUBLICATIONS

P.G.L. Mills and M.O.J. Hawksford, Distortion Reduction in Moving-Coil Loudspeaker Systems Using Current-Drive Technology, J. Audio Eng. Soc., Mar. 1989, 129-148, vol. 37.
D.R. Birt, Nonlinearities In Moving-Coil Loudspeakers With Overhung Voice Coils, J. Audio Eng. Soc., Apr. 1991, 219-231, vol. 39.
Jonathan Scott, Jonathan Kelly and Glenn Leembruggen, New Method of Characterizing Driver Linearity, J. Audio Eng. Soc., Apr. 1996, 258-265, vol. 44.
Wolfgang Klippel, Nonlinear Large-Signal Behavior of Electrodynamic Loudspeakers at Low Frequencies, J. Audio Eng. Soc., Jun. 1992, 483-496, vol. 40.
Johan Suykens, Joos Vandenwalle and Johan Van Ginderdeuren, Feedback Linearization of Nonlinear Distortion in Electrodynamic Loudspeakers, J. Audio Eng. Soc., Sep. 1995, 690-694, vol. 43.

* cited by examiner

POSITION SENSOR FOR A LOUDSPEAKER

FIELD OF THE INVENTION

The present invention relates to a position sensor. More particularly, it relates to a position sensor for providing an electrical signal that varies in a selected manner with the placement of a voice coil from an at rest position, and a method of constructing same.

BACKGROUND OF THE INVENTION

The construction and operation of electro-dynamic loudspeakers are well known. The physical limitations in their construction are one cause of non-linear distortion, which is sensible in the generated sound production. Distortion is particularly high at low frequencies, in relatively small sealed box constructions where cone displacement or excursions are at their maximum limit.

In the past, one of many approaches taken to reduce speaker distortion has been to use motional feedback to compensate for this distortion. Motional feedback controls frequency response and reduces non-linear distortions. Motional feedback is usually implemented using accelerometers, velocity sensors and/or position sensors. In the past, accelerometers have been the most successful, as they are inexpensive and their performance does not depend on the extent of displacement, thereby contributing to the linearity of the output signal. The linearity of any sensor is critical in audio applications, as even very strong feedback cannot reduce distortions beyond those introduced by the sensor itself.

Despite the advantages afforded by the linearity of their output, accelerometers have problems of their own. At low frequencies, the distortions generated by typical speakers are very high. Some components of these distortions can move the speaker cone from its optimal, center position; however, accelerometers will be blind to slow shift in cone position and their output signals will not include information that can be sent back to the amplifier to correct for this slow shift. Similarly, velocity sensors will be blind to cone position.

Position sensors do not suffer from these shortcomings. However, like velocity centers, the operation of position sensors requires two elements to be moved relative to each other. This makes their operation sensitive to cone excursion. Consequently, the signals provided by each will not be linear, particularly at large displacements Thus, there is a need to measure slow shift and cone position. Both accelerometers and velocity sensors are unable to provide this measurement. Position sensors can provide this measurement; however, such sensors themselves create non-linearities. Position sensors that measure the variations in coil induction are generally considered to be the most practical, reliable and least sensitive to the environment of available position sensors. However, such position sensors still suffer from these problems. Existing sensors of this kind typically include multiple coils mounted coaxially with a voice coil of a speaker. A conductive element such as a metal rod or another coil moves inside the external coils. An electrical circuit converts the movement of the interior conductive element in the exterior coil to an electrical signal. However, as described above, the conversion of the displacement to voltage may not be linear, especially for large displacements. In addition, as the coils are mounted coaxially with the speaker voice coil, additional voltages may be induced in the voice coils thereby generating noise.

Accordingly, there is a need for a position sensor that is inexpensive, easy to build, provides a linear output and minimizes the generation of voltage noise in the speaker voice coil.

SUMMARY OF THE INVENTION

An object of an aspect of the present invention is to provide an improved position sensor.

In accordance with this aspect of the present invention there is provided a position sensor for measuring a degree of deflection of a first element relative to a second element. The position sensor comprises (a) an inductance-affecting core mounted on the first element for movement therewith, the inductance-affecting core having a length and a variable inductance-affecting capacity varying along the length; (b) at least one inductor adjoining the inductance-affecting core and mounted on the second element, the at least one inductor having an associated length shorter than the length of the conductor core such that only a variable portion of the inductance-affecting core adjoins the inductor, the variable portion having a variable average inductance-affecting capacity and a portion length substantially equal to the associated length of the at least one inductor; and, (c) a position sensor circuit connected to the at least one inductor for providing a variable signal based on the variable average inductance-affecting capacity of the variable portion of the inductance-affecting core adjoining the at least one inductor. The variable average inductance-affecting capacity of the variable portion varies with the degree of deflection of the first element relative to the second element to vary the variable signal.

An object of a second aspect of the present invention is to provide a method of designing a position sensor for providing an output that varies linearly with displacement.

In accordance with the second aspect of the present invention, there is provided a method of measuring a degree of deflection of a first element relative to a second element. The method comprises (a) selecting a selected variable output signal for measuring the degree of deflection, wherein the variable output signal varies with the degree of deflection; (b) mounting an inductance-affecting core on the first element for movement therewith, the inductance-affecting core having a length and a variable inductance-affecting capacity; (c) mounting at least one inductor on the second element adjoining the inductance-affecting core, the at least one inductor having an associated length shorter than the length of the conductor core such that only a variable portion of the inductance-affecting core adjoins the inductor, the variable portion having a variable average inductance-affecting capacity; (d) connecting the at least one inductor to a position sensor circuit for providing the selected variable output signal based on the variable average width of the variable portion of the position sensor; and (e) configuring the inductance-affecting core to have the variable inductance-affecting capacity required to provide the selected variable signal.

An object of a third aspect of the present invention is to provide an improved loudspeaker.

In accordance with the third aspect of the present invention, there is provided an electro-dynamic loudspeaker. The electro-dynamic loudspeaker comprises (a) a voice coil for generating an acoustic waveform, the voice coil being longitudinally movable from an initial rest position to generate the acoustic waveform, (b) a second element of the loudspeaker, the second element being stationary relative to the voice coil; (c) an inductance-affecting core mounted on the voice coil for movement therewith, the inductance-affecting core having a length and a variable inductance-affecting capacity; (d) at least one inductor adjoining the inductance-affecting core and mounted on the second element, the at least one inductor having an associated length shorter than the length of the conductor core such that only a variable portion of the inductance-affecting core adjoins the inductor, the variable portion having a variable average inductance-affecting capacity and a portion length substantially equal to the associated length of the at least one inductor, and, (e) a position sensor circuit connected to the at least one inductor for providing a variable signal based on the variable average inductance-affecting capacity of the variable portion of the inductance-affecting core adjoining the at least one inductor. The variable average inductance-affecting capacity of the variable portion varies with the degree of deflection of the voice coil relative to the second element to vary the variable signal

BRIEF DESCRIPTION OF THE DRAWINGS

For a better understanding of the present invention and to show more clearly how it may be carried into effect, reference will now be made, by way of example, to the accompanying drawings, which show preferred embodiments of the present invention, and in which.

DETAILED DESCRIPTION OF THE INVENTION

Figure 1:
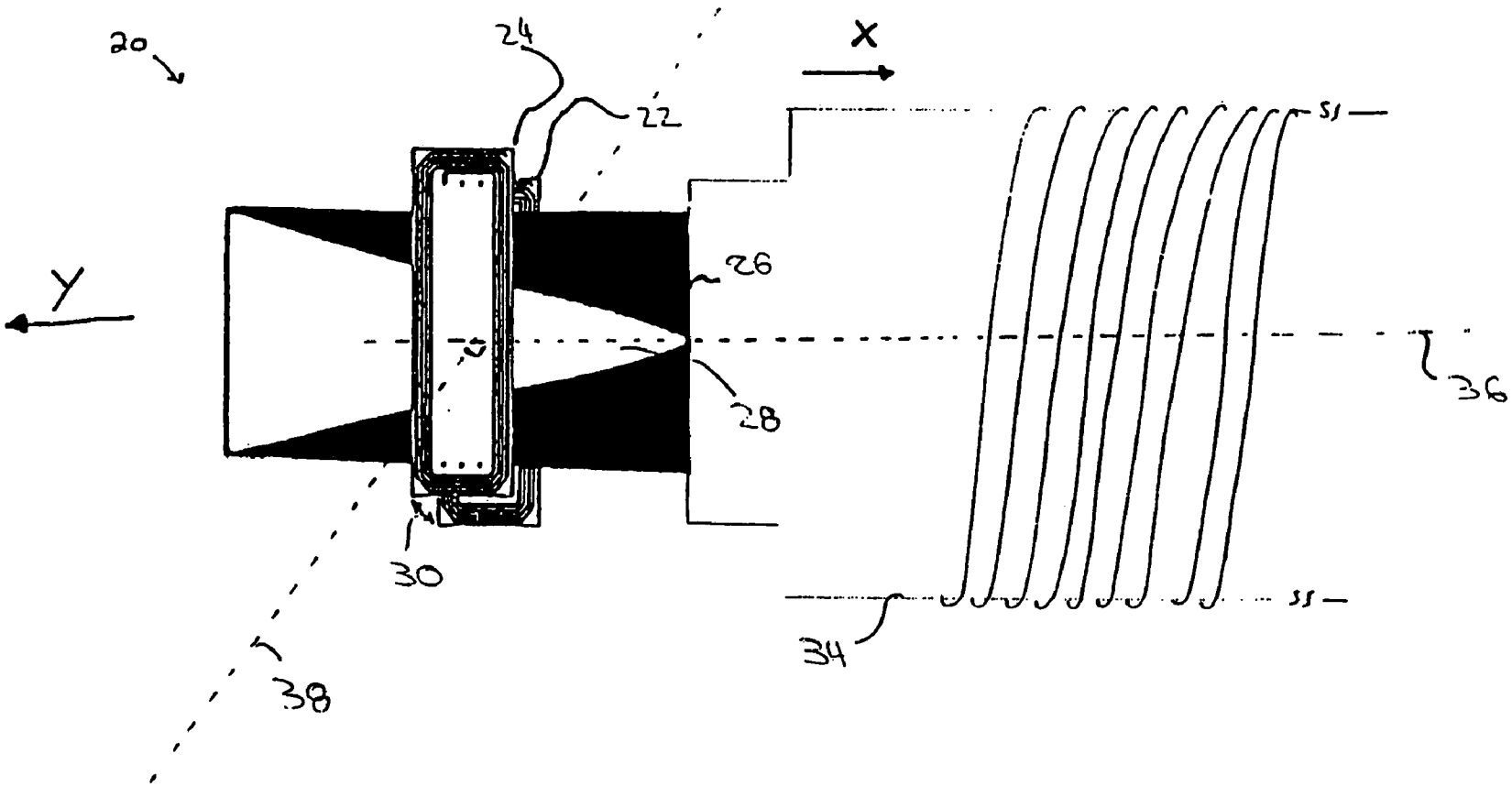
FIG. 1 is a perspective side view of a first embodiment of a position sensor in accordance with the present invention.

FIG. 1 illustrates a position sensor device 20, which includes a first and second inductance coil 22, 24 and an approximately triangular shaped conductive core 26. Optionally, all of these components 22, 24, are manufactured on printed circuit boards (PCB). Furthermore, the coils may be printed on both sides of the PCB boards and electrically connected in series in order to maximize their total inductance A conductive region 28 of the conductive core 26 is longitudinally displaced within a finite gap region, defined by 30. As the conductive core 26 moves in the direction indicated by Arrow X, a larger amount of copper is immersed in the magnetic field generated by the coils 22, 24 This in turn decreases the inductance of the coils 22, 24. Conversely, as the conductive core 26 moves in a direction indicated by Arrow Y, a smaller amount of copper is immersed in the magnetic field generated by the coils 22, 24, which in turn increases the inductance of the coils 22, 24. The conductive core 26 is geometrically compensated in order to ensure that its longitudinal displacement (X or Y Arrow direction) in the center of the finite gap region 30 generates a linear change in the output voltage of the position sensor circuit. Hence, a linear position control signal (position sensor output shown in FIG. 3) is generated as a result of this inductance change. As illustrated in FIG. 1, the shape of the conducting region 28 is not precisely triangular. It is shaped to linearize the relationship between the output voltage of the position sensor 20 and the displacement of the core 26. Conducting region 28 has a curved shape. As illustrated in FIG. 1, in use, the first and second inductance coils 22, 24 are stationary, whilst the conductive core 26 is attached to a bobbin 32 (FIG. 4) of a voice coil 34. Therefore, as the voice coil 34 longitudinally moves, the conductive core 26 is longitudinally displaced within the finite gap region 30 between the coils 22, 24. Hence, the inductance of the coils 22, 24 varies in unison with voice coil movement. Although the coils 22, 24 are stationary and the conductive core 26 moves, in an alternative embodiment, it will be appreciated that the coils 22, 24 may be connected to the voice coil 34, whilst the conductive core 26 remains stationary. However, it is found that by connecting the core 26 to the voice coil 34, a rigid connection which generates satisfactory position sensing is provided.

Figure 2:
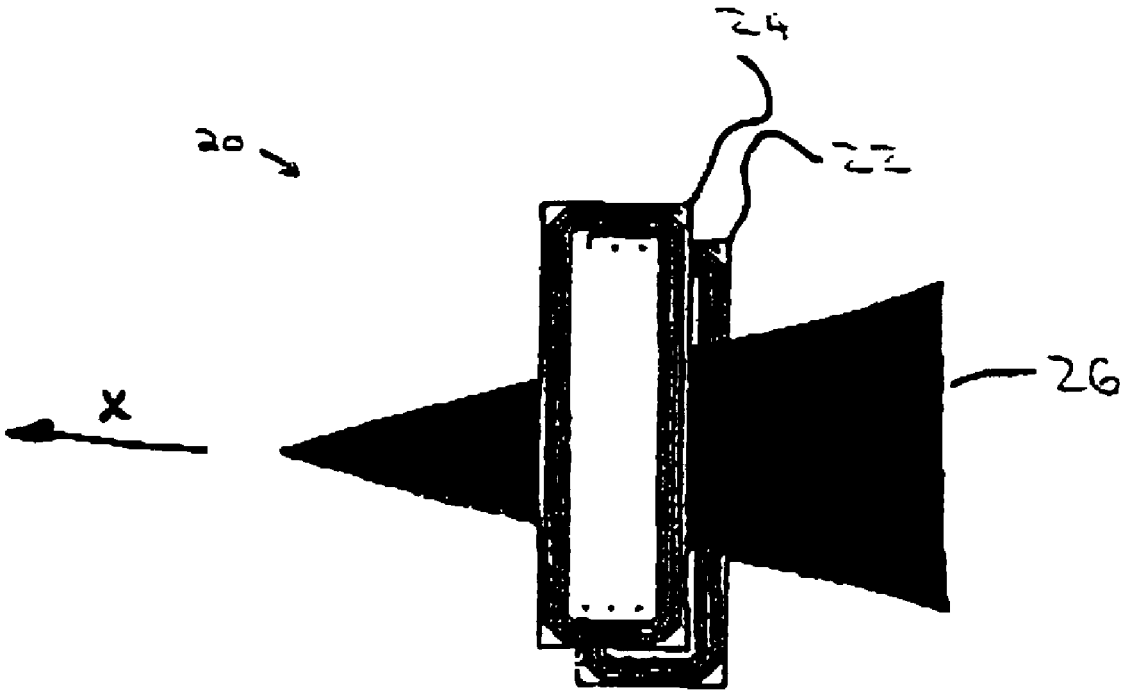
FIG. 2 illustrates, in a perspective side view, an alternative embodiment of the position sensor shown in FIG. 1.

FIG. 2 shows an alternative embodiment of the position sensor 20, wherein the conductive core 26 is comprised solely of a conductive region. The operation of this sensor is essentially the same as that of the sensor described and illustrated in FIG. 1.

Referring to FIG. 1, the position sensor 20 is also positioned, such that no electrical cross talk occurs between the inductance coils 22, 24 and the voice coil 34. This is achieved ensuring that the vector orientation of the magnetic field generated by the inductance coils 22, 24 is orthogonal to the vector orientation of the magnetic field generated by the voice coil 34. In terms of the physical positioning of the inductance coils 22, 24 and the voice coil 34, their respective axes must be orthogonal in order to eliminate electrical cross talk. This means that a concentric longitudinal axis 36, which passes concentrically through the voice coil 34 must be orthogonal to a first axis 38 which passes through the center of both inductance coils 22, 24

Figure 3:
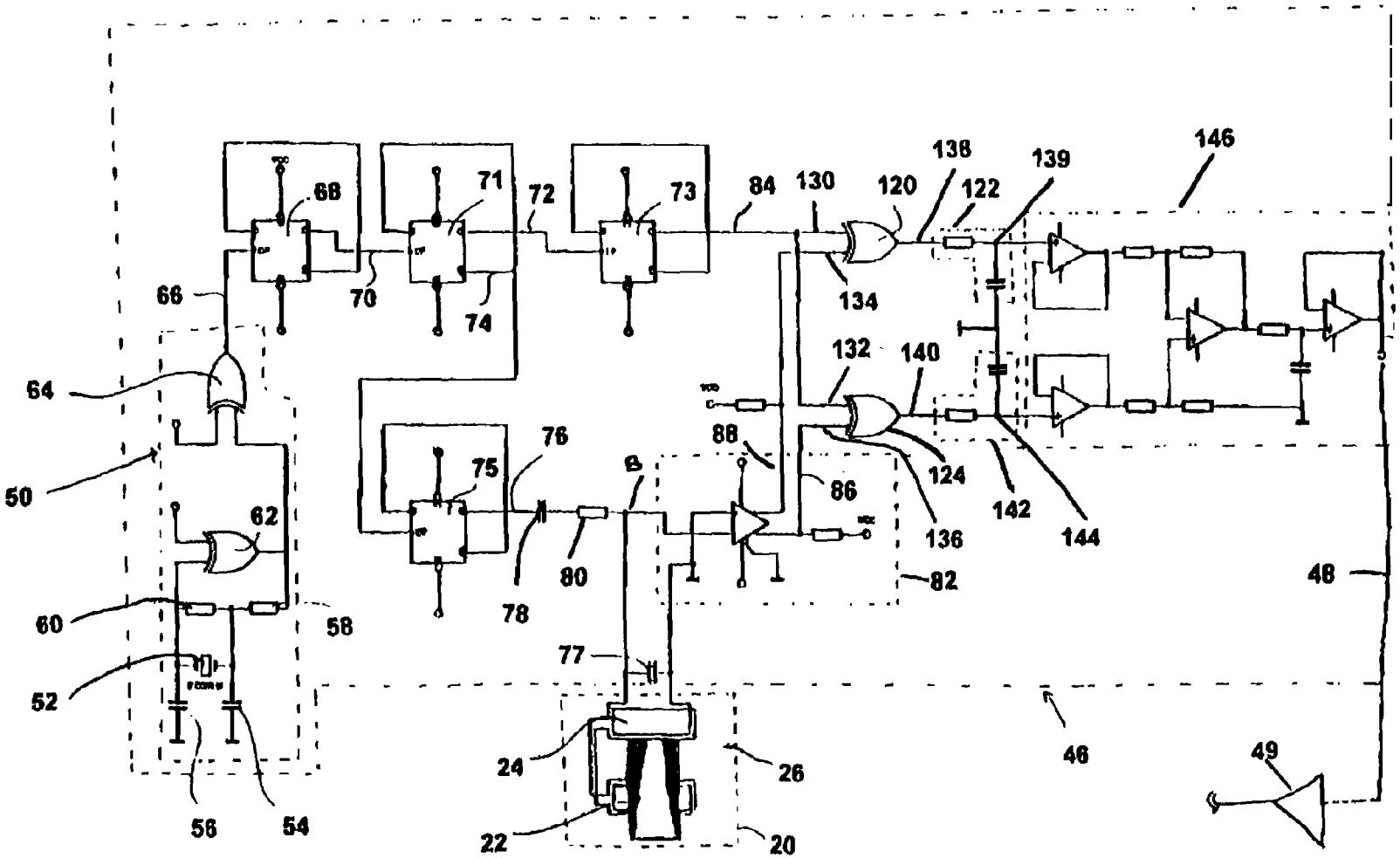
FIG. 3 illustrates, in a schematic diagram, an electrical sensor circuit used in combination with the position sensor of FIG. 2 in a further embodiment of the invention.

FIG. 3 illustrates the position sensor circuit comprising the position sensor device 20 and processing circuit 46. The circuit 46 converts the changes in the inductance of the position sensor 20 and generates the position control signal 48 wherein the voltage magnitude of the position control signal 48 is proportional to the displacement of the core 26 Within the circuit of FIG. 3, an oscillator circuit 50 comprises a crystal (6 MHz, for example) 52, capacitor component 54, capacitor component 56, resistor component 58, resistor component 60, XOR logic gate 62 and XOR logic gate 64. This circuit 50 generates a 6 MHz squarewave signal at the output 66 of XOR gate 64. The 6 MHz squarewave signal at the output 66 of XOR gate 64 is then applied to the clock input of D-Type flip-flop 68, which divides the signal into a 3 MHz squarewave. The 3 MHz output 70 from D-Type flip-flop 68 is applied to the clock input of D-Type flip-flop 71, which further divides the signal into a 1.5 MHz squarewave signal. O-Type flip-flop 71 has two complementary outputs 72, 74, where the first output 72 generates a first 1.5 MHz squarewave, which is applied to the clock input of D-Type flip-flop 73. The second output 74 generates a second 1.5 MHz squarewave, which is 180 degrees out of phase with the a first 1.5 MHz squarewave. This signal is applied to the clock input of D-Type flip-flop 75 D-Type flip-flop 73 divides the first 1.5 MHz squarewave to a first 750 KHz squarewave signal, which is present at its output 84. Similarly, D-Type flip-flop 75 divides the second 1.5 MHz squarewave to a second 750 KHz squarewave signal, which is present at its output 76 The first and second 750 KHz squarewaves are 90 degrees out of phase as a result of being clocked by the anti-phase first and second 1.5 MHz squarewaves.

The series connected coils 22, 24 and capacitor 77 provide a parallel resonant circuit tuned to 750 KHz when the conductive core 26 is in its center position (i.e. voice coil is in the optimum operating region). The second 750 KHz squarewave at output 76 is filtered by capacitor 78 and resistor 80, such that at point B at the terminal of resistor 80, the second 750 KHz squarewave is converted to a 750 KHz sinusoidal signal of the same phase. Provided that the triangular conductive core 26 is in its center position, the phase of the 750 KHz sinusoidal signal does not change. The 750 KHz sinusoidal signal is then re-converted back to a 750 KHz squarewave by comparator circuit 82, whereby if the phase has not been affected by the resonant circuit (i.e. core 26 is in its center position), the 750 KHz squarewave has the same phase as the signal output from D-Type flip-flop 75 Therefore, it will still have a 90-degree phase shift relative to the first 750 KHz signal generated by the output 84 of D-Type flip-flop 73. It will be appreciated however, that the comparator circuit 82 has first and second complementary outputs 86, 88 that are 180 degrees out of phase. Hence, the first output 88 will have the same 90-degree phase shift relative to the first 750 KHz signal generated by the output 84 of D-Type flip-flop 73, and the second output 86 will have a 270-degree phase shift relative to this signal (output from 84).

EXOR logic gate 120 and low pass filter network 122 form a first phase comparator circuit, whilst EXOR logic gate 124 and low pass filter network 142 form a second phase comparator circuit. The first 750 KHz signal generated by the output 84 of D-Type flip-flop 73 is applied to the first input 130, 132 of both the first and second phase comparator network, respectively. Also, the first output 88 and the second output 86 from comparator 82 are applied to the second input 134, 136 of the first and second phase comparator network, respectively.

Under these conditions, where the triangular core 26 is in the rest position, and the signals from the comparator 82 output 88 and the D-Type flip-flop 73 output 84 have a 90 degree phase difference, the first phase comparator XOR gate 120 output 138 will generate a squarewave signal with a 50% duty cycle. Therefore, the corresponding averaging applied to this signal by the low pass filter 122 will generate a DC voltage of 0 V at output 139. Similarly, when the signals from the comparator 82 complementary output 86 and the output 84 from D-Type flip-flop 73 have a 270-degree phase difference, the second phase comparator XOR gate 124 output 140 will also generate a squarewave signal with a 50% duty cycle. Accordingly, this signal is averaged through the low pass filter 142, wherein the averaged signal at output 144 is a DC voltage of approximately 0 V. Both DC outputs 139, 144 from the phase comparators are received by a differential amplifier 146, which generates a difference signal based on the DC outputs 139 and 144. This corresponding difference signal is the position control signal, and is amplified by amplifier 49.

Under the conditions where the speaker voice coil movement is centered about a position offset from its center position (i.e. optimum operating region centered about rest position), the change in inductance of the position sensor 20 varies with the resonance frequency of the parallel resonance circuit generated by the coils 22, 24 and capacitor 77. This in turn causes an additional phase shift in the 750 KHz sinusoidal signal, at point B, relative to the first 750 KHz squarewave signal, which is present at the output 84 of D-Type flip-flop 73 The relative phase difference between these two signals will depart from 90-degrees (depending on direction of core 26 movement), which causes one output (e.g. 138) from one XOR gate (e.g. 120) to generate a squarewave signal with a duty cycle greater than 50%, whilst the other output (e.g. 140) from the other XOR gate (e.g. 124) generates a squarewave signal with a duty cycle less than 50%. DC averaging of the squarewave with a duty cycle greater than 50% will generate a positive DC voltage in proportion to the width of the pulses. Also, DC averaging of the squarewave with a duty cycle less than 50% will generate a lesser magnitude DC voltage in proportion to the width of the pulses. The DC voltages from the low pass filter 122, 142 outputs 139, 144 are received by the differential amplifier 146, and a corresponding position control signal 48 is generated. The more the core 26 is displaced relative to its center position, the more the duty cycle of the squarewave signals is effected. Therefore, the magnitude difference between the DC voltages generated by averaging these squarewaves is increased. Hence, the position control signal 48 generated by the differential amplifier 146 increases. The generated position control signal 48 is directly proportional to the voice coil 34 and hence the core 26 displacement (see FIG. 1). This signal 48 is amplified, as indicated at 149, and may then be applied to provide feedback to compensate for distortion as described, for example, in a co-pending application by the same applicant and also claiming priority from U.S. application No. 60/329,350.

Figure 4:
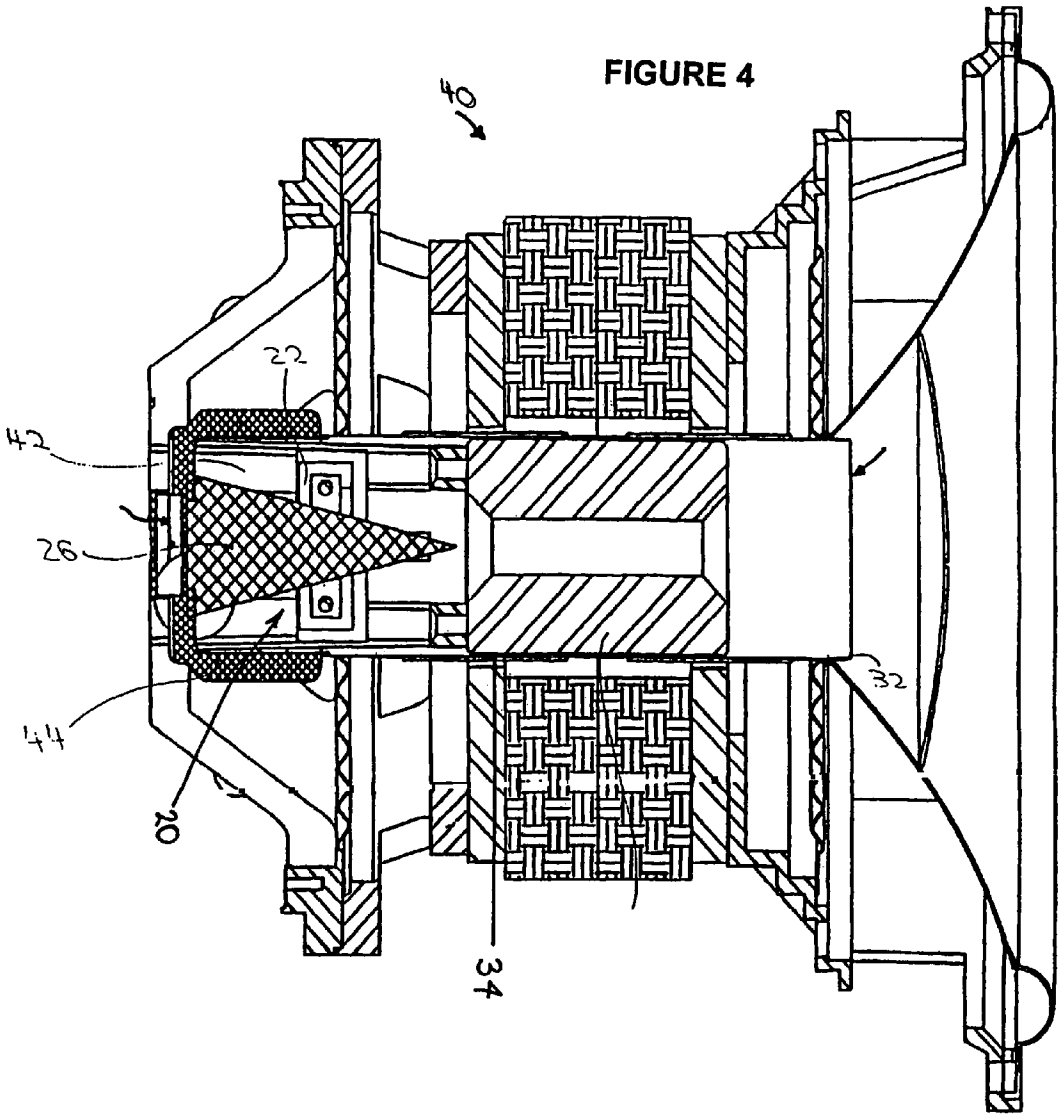
FIG. 4, in a sectional view, illustrates a cross section of the mechanical construction of the speaker device and the relative position of the position sensor.

FIG. 4 illustrates an example of the mechanical construction of a speaker device 40 and the relative position of the acceleration sensor 42 and position sensor 20 As illustrated in the FIG. 4, the acceleration sensor 42 and position sensor's triangular conductive core 26 are connected to the bottom region of the voice coil bobbin 32. The first and second inductance coils 22 (only one coil shown) are connected to a fixed (stationary) position or physical location on the speaker on either side of the triangular conductive core 26. Consequently, as the voice coil 34 moves, the triangular conductive core 26 moves within the inductance coils 22. Therefore, the position sensor 20 generates the electrical feedback control signal (or position control signal) necessary for distortion reduction. As shown in FIG. 4, the triangular conductive core 26 is connected to the bobbin 32 by means of bracket 44. The acceleration sensor 42 also generates the electrical feedback control signal, which is linearly proportional to the movement of the voice coil 34 and bobbin 32.

Shaping the Position Sensor to Provide a Linear Output Voltage

In accordance with a preferred aspect of the invention, a suitable conductive core 26 can be designed using empirical data obtained regarding the interaction of the material from which the conductive core is made with the other components of the loudspeaker. To begin, a regular, triangular-shaped conductive core is made from a selected conductive material such as a printed circuit board. The height of this triangle must be sufficient to extend over the entire maximum desirable stroke of the cone. After inserting the triangular element halfway between coils 22, 24, the capacitor of FIG. 3 is adjusted to get zero volts of the circuit output 92. The coils 22, 24 and triangular core 26 are installed in a designated speaker as the proximity of the speaker construction elements will help to determine what shape provides the desired output. A series of measurements must then be made covering the entire range of displacement.

Figure 5:
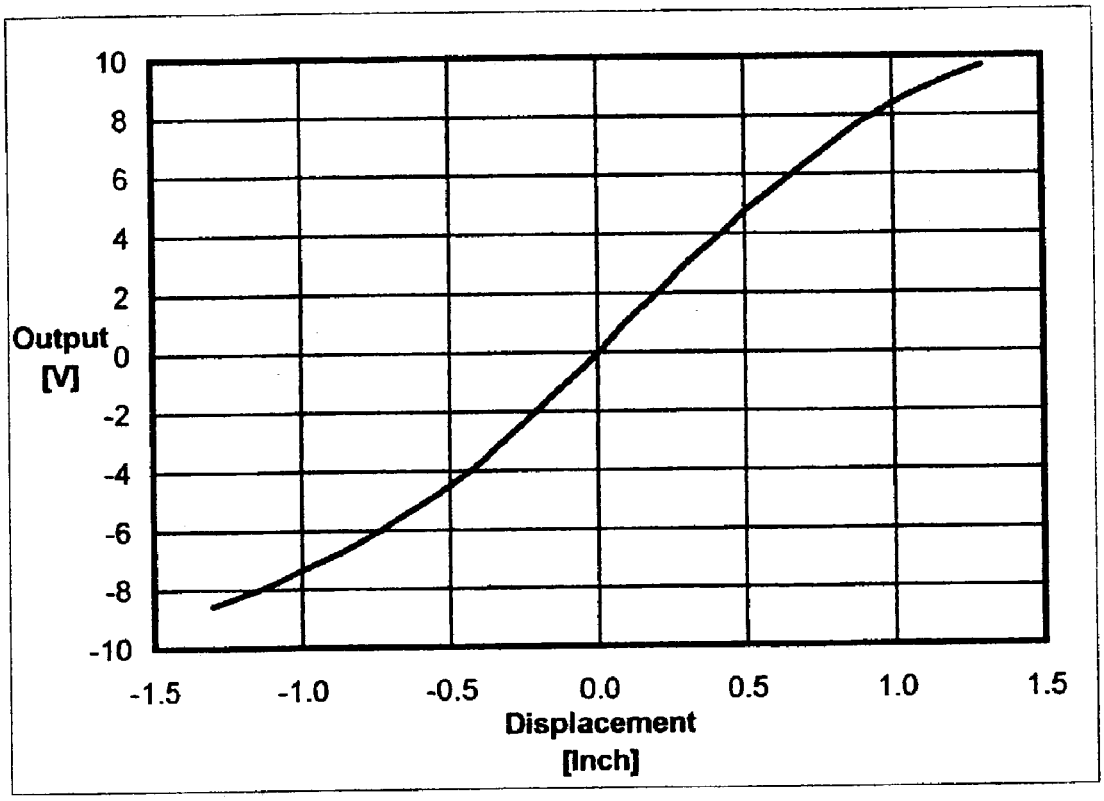
FIG. 5 is a graph plotting the output voltage produced by a prior art position sensor against the displacement of a triangular conductive core of the position sensor.

Referring to FIG. 5, there is illustrated in a graph, the outcome of a test using a regular triangular conductive core 26. Specifically, in FIG. 5, output voltage in volts is plotted against displacement in inches. Despite the linearity of the width of the triangular conductive core 26 relative to distance from its base, the output voltage clearly departs from linear Only a portion of the triangular conductive core 26 influences the resonance frequency of the coils 22, 24 and the capacitor 77. This portion is located between the two coils 22, 24. Thus, there is a relationship between the width of the triangular conductive core 26 of the geometrical center of the coils 22, 24, and system resonance.

As the conductive core 26 being tested is a regular triangular shape, there is a linear relation between the width of that portion of the triangular conductive core 26 that is between the coils 22, 24 and the displacement of the triangular conductive core 26 from a reference position.

Figure 6:
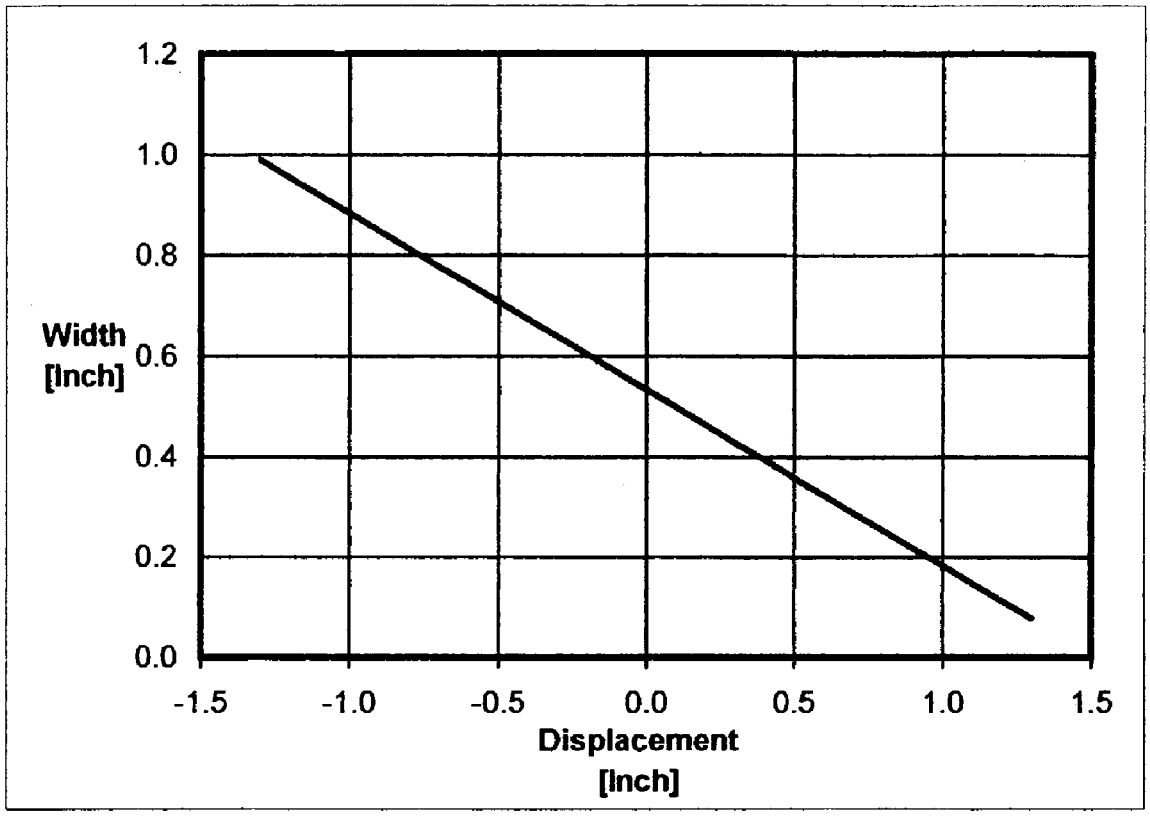
FIG. 6 is a graph plotting the width of the conductive core of FIG. 5 against its displacement.

Referring to FIG. 6, this relation is illustrated in a graph plotting the average width of that portion of the triangular conductive core that is between the coils 22, 24 against displacement of the triangular conductive core 26 from a rest position. No measurements are required to provide this graph, as the dimensions of the triangular conductive core 26 are known. As the conductive core 26 is of a regular triangular shape, the relationship between displacement and width is, of course, linear.

Figure 7:
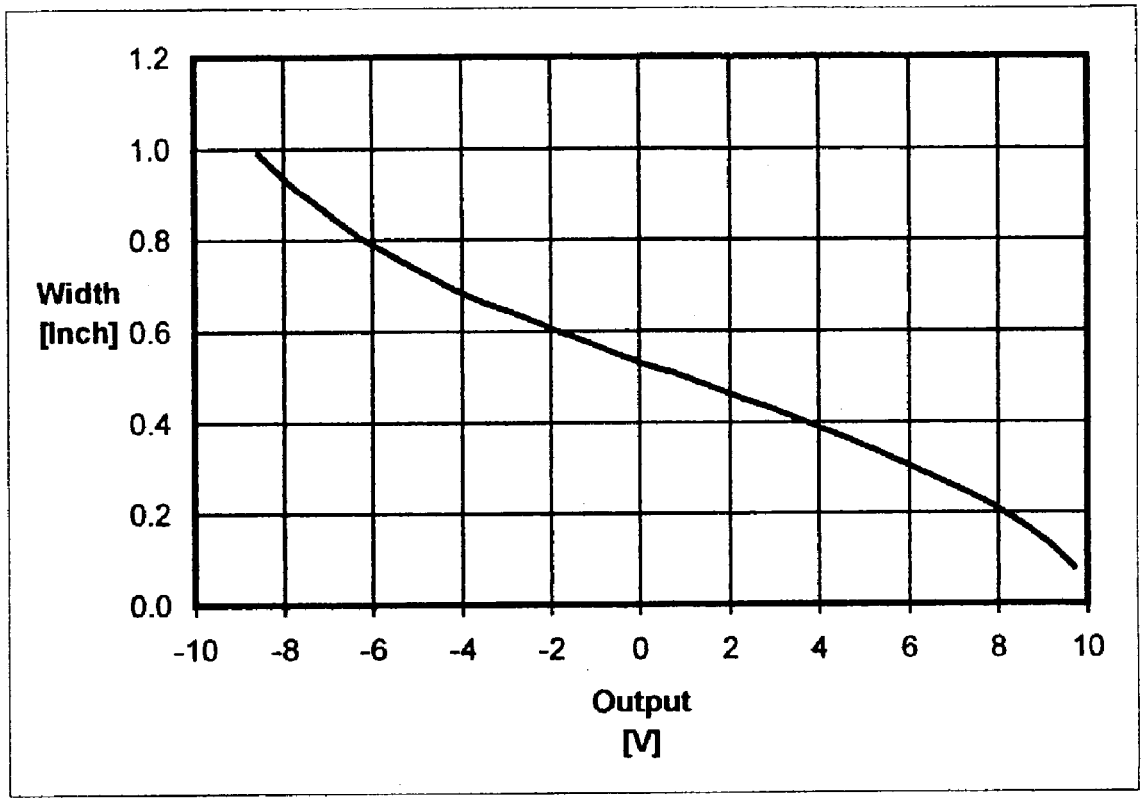
FIG. 7 is a graph plotting the width of a conductive core of a position sensor of FIG. 5 against the output voltage of the position sensor.

Using the graphs of FIGS. 5 and 6, another graph, FIG. 7, may be plotted. The graph of FIG. 7 is generated by replacing the displacement axis of the graph of FIG. 6 with the corresponding output voltage determined by the graph of FIG. 5. For example, FIG. 5 indicates that a displacement of approximately −0.2 inches corresponds to an output voltage of approximately −2 volts. Referring to FIG. 6, a displacement of approximately −0.2 inches corresponds to a width of 0.6 inches. Thus, in FIG. 7, an output voltage of −2 volts corresponds approximately to a width of 0.6 inches.

Figure 8:
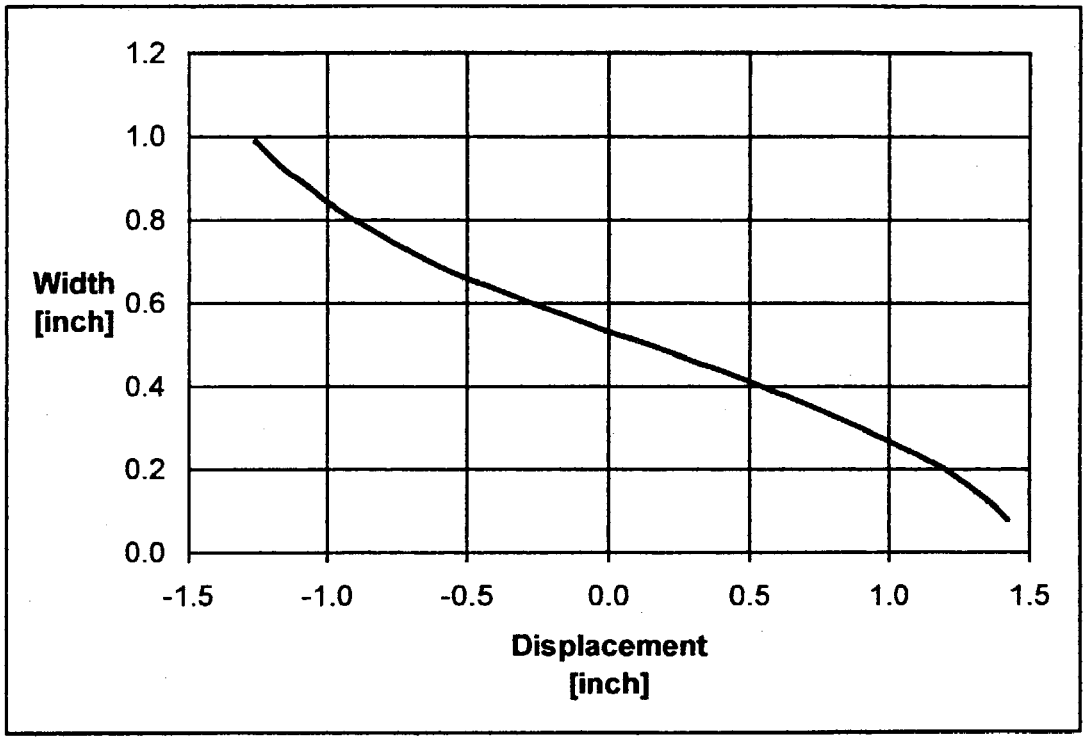
FIG. 8 is a graph plotting width of a conductive core of the linear position sensor in accordance with a further embodiment of the invention against a displacement of the conductive core.

The position sensor 20 has a position sensor sensitivity S, which can be expressed in volts per inch. In the present example, the position sensor sensitivity is 6.8 volts per inch. Using this position sensor sensitivity, another graph similar to FIG. 7 can be plotted; however, in this graph the horizontal axis is not in volts but in inches. That is, by dividing the output voltage shown on the X axis of the graph of FIG. 7 by the position sensor sensitivity, the displacements corresponding to these output voltages can be determined Referring to FIG. 8, the width of a triangular conductive core in inches is plotted against these displacements. The graph of FIG. 8 has the same units along its X and Y axes as the graph of FIG. 6. However, the graph of FIG. 6 represents a triangle. Clearly, the graph of FIG. 8 represents a shape that is roughly triangular, but departs from the triangular as the width does not vary absolutely linearly with the displacement. Based on the graph of FIG. 8, a position sensor 20 can be designed in which the width varies according to the displacement in the manner shown in FIG. 8.

Figure 9:
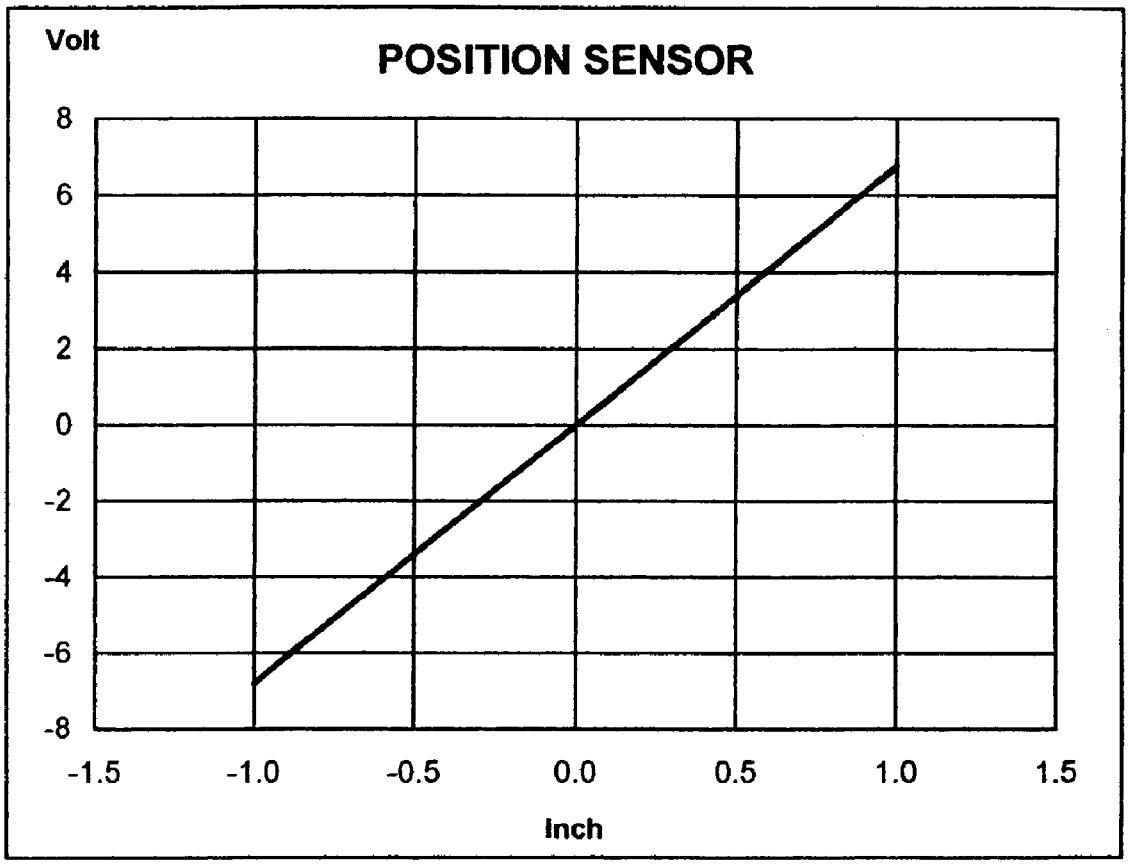
FIG. 9 is a graph plotting the output voltage produced by the linear position sensor of FIG. 8 against the displacement of the linear position sensor.

Referring to FIG. 9, the output voltage generated by a position sensor 20 manufactured according to the specifications of the graph of FIG. 8 is plotted against the displacement of this position sensor 20. As can be seen, the output voltage of this position sensor 26 varies substantially linearly with displacement.

It is important to note that the foregoing method can be applied to design position sensors providing any one of a number of desired voltage outputs, and is not limited to merely providing linear outputs. Such non-linear outputs may be used to compensate for various sources of speaker non-linearity. One such source is the motor that drives the voice coil 34. In the motor, a current i, flowing through the voice coil 34 generates a force F according to the following equation:

$$F=Bl\cdot i$$

where Bl is the force factor.

However, Bl is not constant, but is a function of voice coil displacement X:

$$F=Bl(x)\cdot i$$

As the displacement of the motor increases, the force Bl is significantly reduced to below what it should be, creating harmonic distortions. A typical relationship between Bl and displacement is illustrated in the graph of FIG. 10, which plots displacement against the ratio of actual force factor to the force factor when the voice coil 34 is at rest.

Figure 10:
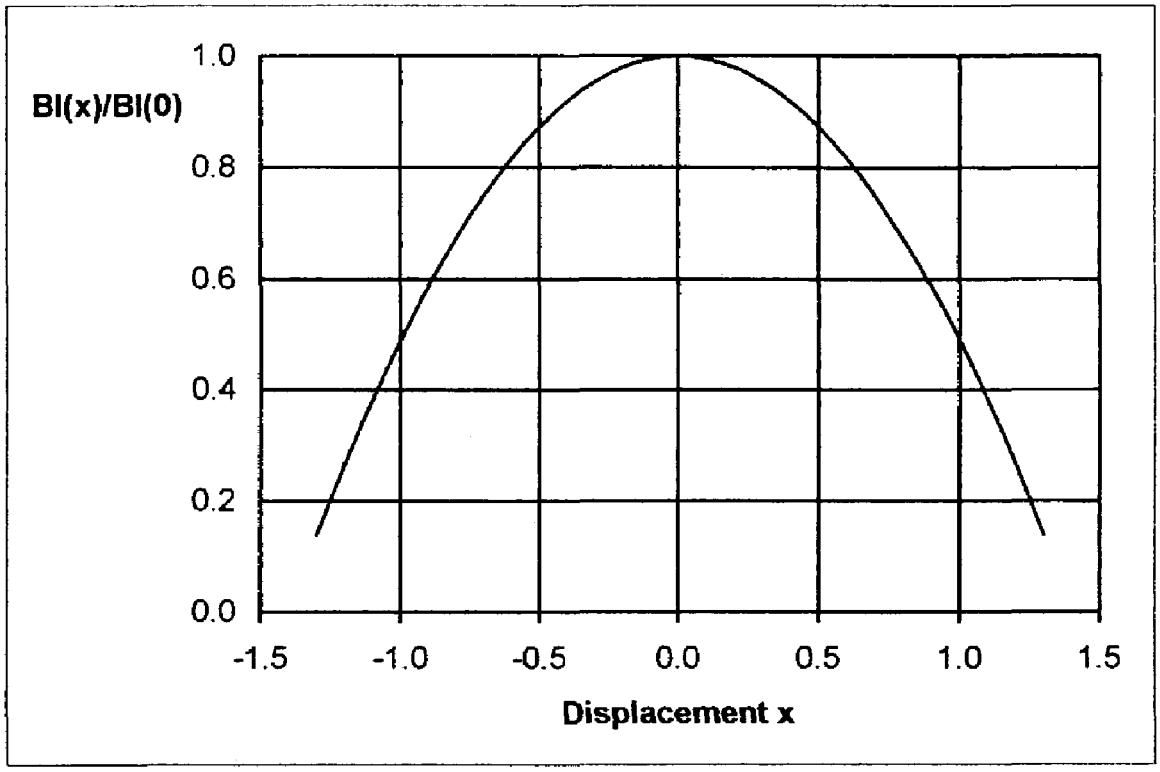
FIG. 10 is a graph plotting the ratio of the force factor at a particular displacement of a voice coil to the force factor at a rest position against the displacement of the voice coil.

The curve of FIG. 10 is parabolic. This is often, but not always, a good model of reality. Designers will sometimes want to know how the force factor really varies with the displacement. A position sensor designed in accordance with the present invention can help to provide this information.

FIG. 7 plots the relationship between the width of a triangular core and the output voltage. Specifically, using the relationship plotted in FIG. 7, a designer can decide on what output voltage is desired at each displacement position of the position sensor, and then can shape the conductive element such that the width at that position displacement is the width corresponding to the desired output voltage on the line plotted in FIG. 7. A designer may construct almost any conductive element, having almost any variation of width as a function of its displacement to obtain almost any transfer function (of course, the designer will be limited by the distance between the coils 22, 24 as the maximum depth of the conductive element cannot exceed this distance). The procedure is much the same as in the case of a linear sensor.

The only difference in the present example, it that the target transfer function is parabolic.

Figure 11:
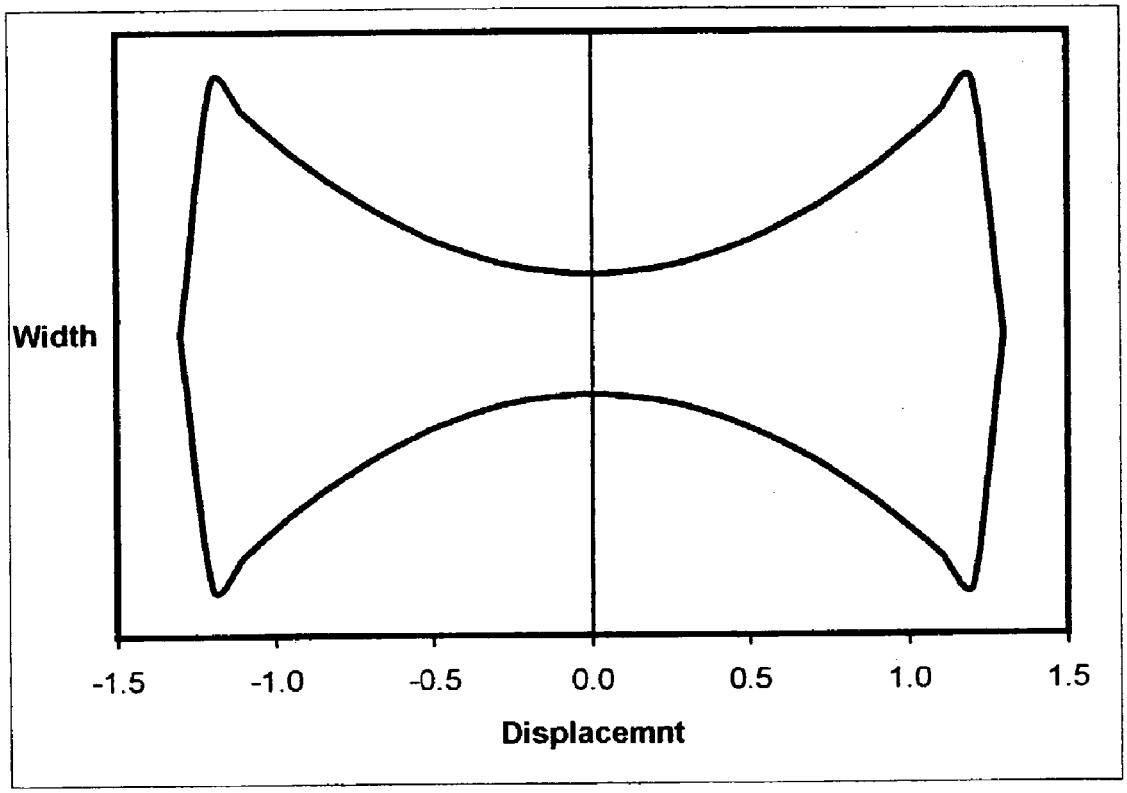
FIG. 11 is a graph plotting width of a conductive core of an inverse parabolic position sensor in accordance with a further embodiment of the invention against a displacement of the conductive core.
Figure 12:
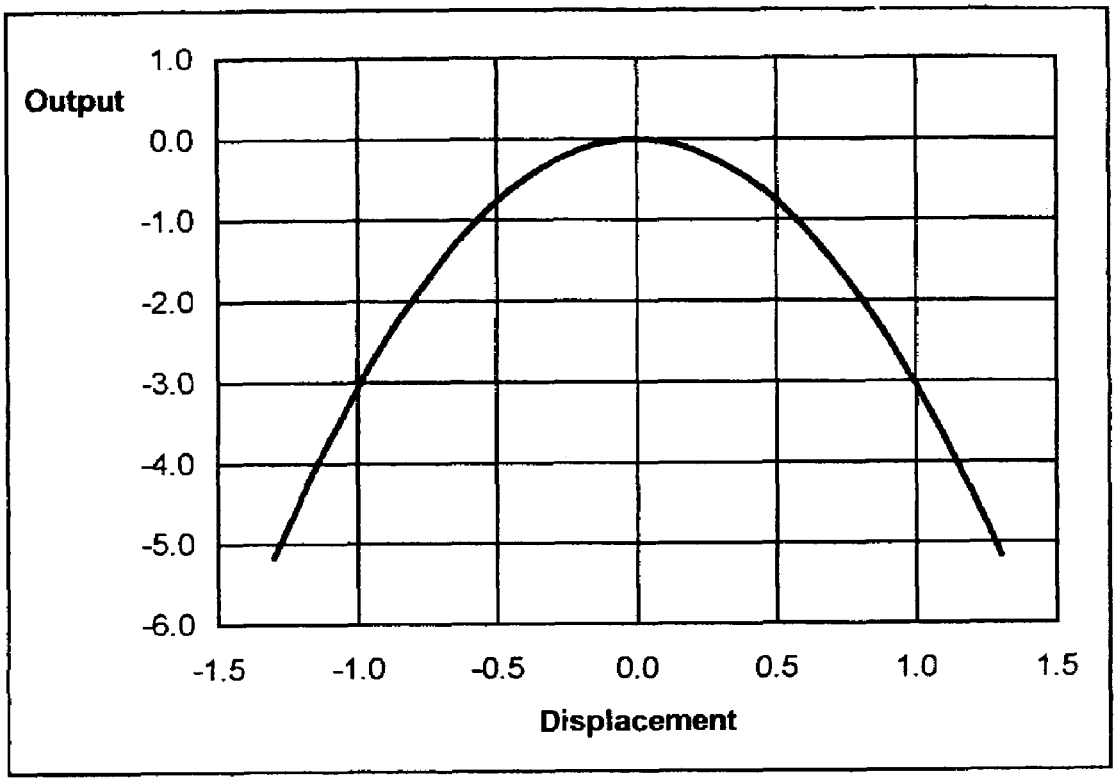
FIG. 12 is a graph plotting the output voltage produced by the inverse parabolic position sensor of FIG. 11 against the displacement of this inverse parabolic position.
Figure 13:
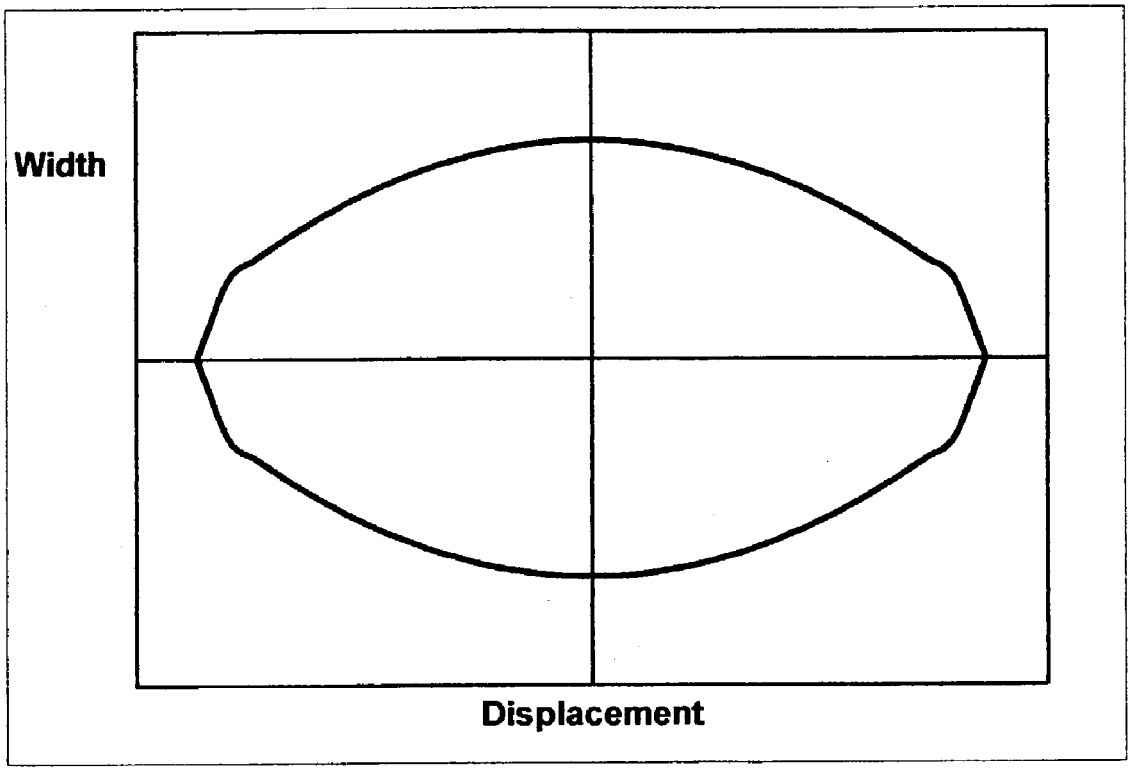
FIG. 13 is a graph plotting width of a conductive core of a parabolic position sensor against displacement of the conductive core.
Figure 14:
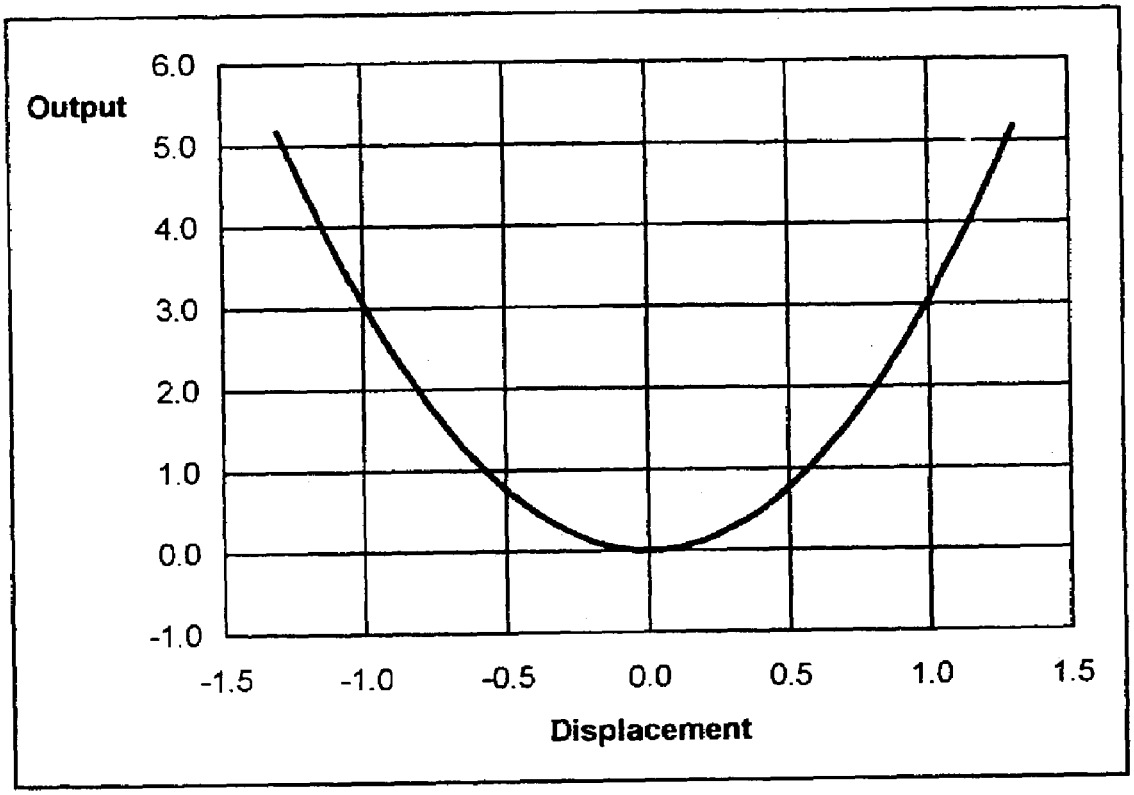
FIG. 14 is a graph plotting the output voltage produced by the parabolic position sensor of FIG. 13 against the displacement of a parabolic position sensor; and, FIG. 15 is a schematic diagram of a loudspeaker with a motional feedback system for reducing non-linear distortion of the loudspeaker.

Referring to FIG. 11, the rough shape of a conductive element required to obtain a parabolic transfer function is illustrated in a graph plotting width against displacement. The transfer function provided by this shape is shown on the graph of FIG. 12, which plots output voltage in volts against displacement. Alternatively, a parabolic transfer function can be obtained using a conductive element having the shape illustrated in the graph of FIG. 13, which plots displacement against width. The transfer function provided by the conductive element shape of FIG. 13 is illustrated in the graph of FIG. 14, which plots output voltage against displacement. The transfer function of FIG. 14 is inverted relative to the transfer function of FIG. 12. Thus, depending on the application, one of these transfer functions will require a voltage inverter and an associated circuit. Further, both of these transfer functions must be shifted to provide a transfer function similar to that shown in FIG. 10.

Figure 15:
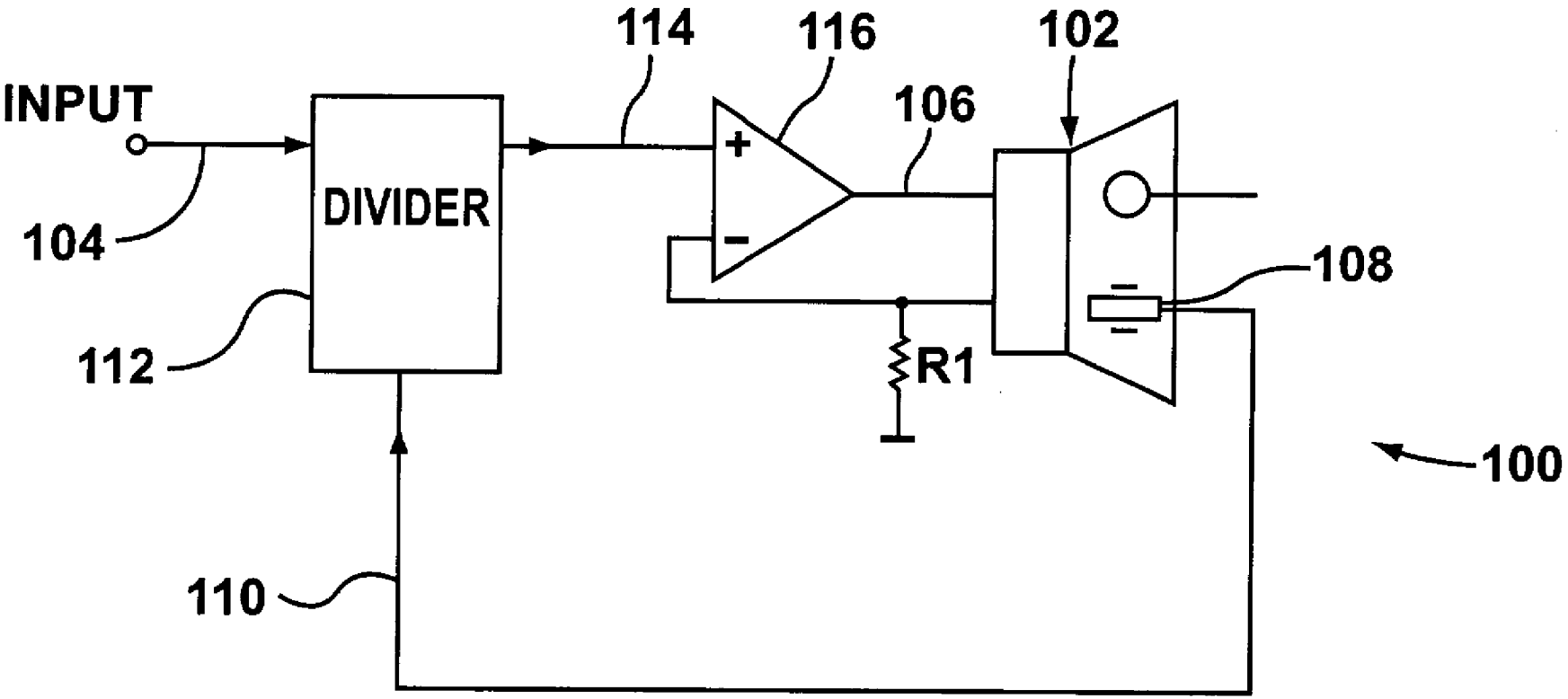

Referring to FIG. 15 there is illustrated in a schematic diagram, a loudspeaker 102 having a motional feedback system 100 for reducing non-linear distortion introduced by the motor driving the voice coil. The loudspeaker 102 comprises a position sensor 108. This position sensor has the configuration of the position sensor represented by the graph of FIG. 11. Accordingly, this position sensor 108 has an output voltage $$(V_{ps}) = k \cdot \frac{Bl(x)}{Bl(0)} \cdot V_{ps}$$

110 is transmitted to feedback network 112, which also receives input audio signal 104. Divider 112 then provides an output voltage 114, which is amplified and converted to an audio current drive signal 106 by power amplifier 116 Audio current drive signal ($I_a$) is determined as follows $$\left(I_a = \frac{\text{Input}}{V_{ps}}\right)$$

Thus, the force generated by the speaker motor structure is $$F = Bl(x) \cdot \frac{\text{Input}}{V_{ps}}$$

Recall, however, that $$(V_{ps}) = k \cdot \frac{Bl(x)}{Bl(0)}$$

By combining the two foregoing equations, one gets $$F = Bl(0) \cdot \frac{\text{Input}}{k}$$

Thus, the force generated by the speaker motor structure is a function of the input signal only, and the distortions are compensated for this solution is superior to the prior art solutions in that the prior art solutions require a special circuit inserted between the position sensor 108 and the divider 112 This additional circuit models the Bl(x) function. In contrast, or according to the present invention, the sensing and modeling are done by the same sensor, and modeling of Bl(x) is done with high precision for no extra effort or cost.

Other variations and modifications of the invention are possible. For example, while the foregoing description has focused on position sensors that provide a linear or parabolic output relative to displacement, as described above, the potential output that can be provided by a position sensor according to the present invention is not limited to these two embodiments, that may be used to provide a wide range of different output voltages. Further, while the position sensor has been described in the context of loudspeakers, it will be appreciated by those skilled in the art that the position sensor may also be applied in other context.

Also, while the present invention as described above is implemented using conductive cores, it will be appreciated by those skilled in the art that it may also be implemented using a ferromagnetic core. In general it is only required that the core affect the inductance in some way, by either increasing or decreasing it, so that the change in inductance can be determined, which in turn enables the degree of movement or deflection to be determined. If a ferromagnetic core is used, then increasing the width of the core will tend to increase inductance instead of diminishing it, requiring design modification. Further, while the above-described inductance-affecting capacity of the core is varied by varying the width, it will be appreciated by those skilled in the art that inductance-varying capacity may also be varied in other ways, such as, for example, by varying the composition or thickness of the core along its length, or by adding grooves to vary its resistance. All such modifications are within the sphere and scope of the invention as defined by the claims appended hereto.

The invention claimed is:

1. A position sensor for measuring a degree of deflection of a first element relative to a second element, the position sensor comprising:

an inductance-affecting core mounted on the first element for movement therewith, the inductance-affecting core having a length and a variable inductance-affecting capacity varying along the length;

at least one inductor adjacent to the inductance-affecting core and mounted on the second element such that the inductance-affecting core is outside of each inductor, the at least one inductor having an associated length shorter than the length of the inductance-affecting core such that only a variable portion of the inductance-affecting core is adjacent to the inductor, the variable portion having a variable average inductance-affecting capacity and a portion length substantially equal to the associated length of the at least one inductor; and, a position sensor circuit connected to the at least one inductor for providing a variable signal based on the variable average inductance-affecting capacity of the variable portion of the inductance-affecting core adjacent to the at least one inductor;

wherein the variable average inductance-affecting capacity of the variable portion varies with the degree of deflection of the first element relative to the second element to vary the variable signal.

2. The position sensor as defined in claim 1 wherein the inductance-affecting core has a variable width for providing the variable inductance-affecting capacity, the variable portion has a variable average width for providing the variable average inductance-affecting, and the variable width of the inductance-affecting core is selected such that the variable output signal, resulting from the average variable width of the variable portion of the inductance-affecting core adjacent to the at least one inductor varies substantially according to a selected function of the displacement.

3. The position sensor as defined in claim 2 wherein the inductance-affecting core is substantially flat.

4. The position sensor as defined in claim 3 wherein the inductance-affecting core is formed of a printed circuit board.

5. The position sensor as defined in claim 2 wherein the inductance-affecting core is conductive.

6. The position sensor as defined in claim 2 wherein the at least one inductor comprises a pair of inductors on opposite sides of the inductance-affecting core.

7. The position sensor as defined in claim 2 wherein the selected function is a linear function.

8. The position sensor as defined in claim 2 wherein the selected function is the displacement squared.

9. The position sensor as defined in claim 2 wherein the selected function is the inverse of the displacement squared.

10. The position sensor of claim 1 wherein each inductor has a central axis, and the movement of the inductance-affecting core is in a direction orthogonal to the central axis of each inductor.

11. A method of measuring a degree of deflection of a first element relative to a second element, the method comprising:

(a) selecting a selected variable output signal for measuring the degree of deflection, wherein the variable output signal varies with the degree of deflection;

(b) mounting an inductance-affecting core on the first element for movement therewith, the inductance-affecting core having a length and a variable inductance-affecting capacity;

(c) mounting at least one inductor on the second element adjacent to the inductance-affecting core such that the inductance-affecting core is outside of each inductor, the at least one inductor having an associated length shorter than the length of the inductance-affecting core such that only a variable portion of the inductance-affecting core is adjacent to the inductor, the variable portion having a variable average inductance-affecting capacity;

(d) connecting the at least one inductor to a position sensor circuit for providing the selected variable output signal based on the variable average width of the variable portion of the position sensor; and (e) configuring the inductance-affecting core to have the variable inductance-affecting capacity required to provide the selected variable signal.

12. The method as defined in claim 11 further comprising:

mounting a test inductance-affecting core on the first element for movement therewith, the test inductance-affecting core having a test length and a known variable inductance-affecting capacity;

deflecting the first element relative to the second element to provide a variable test output signal correlated with the degree of deflection, wherein the variable test output signal varies with the deflection of the first element relative to the second element; and based on the known variable inductance-affecting capacity and the variable test output signal selecting the variable inductance-affecting capacity of the inductance-affecting core to provide the selected variable output signal.

13. The method as defined in claim 12 wherein the test inductance-affecting core is substantially flat and triangular;

the test inductance-affecting core has a known variable width for providing the known variable inductance-affecting capacity;

the inductance-affecting core has a variable width for providing the variable inductance-affecting capacity;

the variable portion has a variable average width for providing the variable average inductance-affecting capacity; and, the step of selecting the variable inductance-affecting capacity of the inductance-affecting core to provide the selected variable output signal comprises selecting the variable width of the inductance-affecting core to provide the selected variable output signal.

14. The method as defined in claim 13 wherein the inductance-affecting core and the test inductance-affecting core are conductive.

15. The method as defined in claim 14 wherein the inductance-affecting core and the test inductance-affecting core are made of printed circuit board.

16. The method as defined in claim 13 wherein the variable width of the inductance-affecting core is selected such that the variable output signal, resulting from the average variable width of the variable portion of the inductance-affecting core adjacent to the at least one inductor, varies substantially linearly with the degree of deflection of the first element relative to the second element.

17. The method as defined in claim 13 wherein the variable width of the inductance-affecting core is selected such that the variable output signal, resulting from the average variable width of the variable portion of the inductance-affecting core adjacent to the at least one inductor, varies substantially linearly with the degree of deflection squared.

18. The method as defined in claim 13 wherein the variable width of the inductance-affecting core is selected such that the variable output signal, resulting from the average variable width of the variable portion of the inductance-affecting core adjacent to the at least one inductor, varies substantially inversely with the degree of deflection squared.

19. The method of claim 11 wherein each inductor has a central axis, and the movement of the inductance-affecting core is in a direction that is orthogonal to the central axis of each inductor.

20. An electro-dynamic loudspeaker comprising:

a) a voice coil for generating an acoustic waveform, the voice coil being longitudinally movable from an initial rest position to generate the acoustic waveform;

b) a second element of the loudspeaker, the second element being stationary relative to the voice coil;

c) a inductance-affecting core mounted on the voice coil for movement therewith, the inductance-affecting core having a length and a variable inductance-affecting capacity;

d) at least one inductor adjacent to the inductance-affecting core and mounted on the second element such that the inductance-affecting core is outside of each inductor, the at least one inductor having an associated length shorter than the length of the inductance-affecting core such that only a variable portion of the inductance-affecting core is adjacent to the inductor, the variable portion having a variable average inductance-affecting capacity and a portion length substantially equal to the associated length of the at least one inductor; and, e) a position sensor circuit connected to the at least one inductor for providing a variable signal based on the variable average inductance-affecting capacity of the variable portion of the inductance-affecting core adjacent to the at least one inductor;

wherein the variable average inductance-affecting capacity of the variable portion varies with the degree of deflection of the voice coil relative to the second element to vary the variable signal.

21. The electro-dynamic loudspeaker as defined in claim 20 wherein the inductance-affecting core has a variable width for providing the variable inductance-affecting capacity, and the variable portion has a variable average width for providing the variable average inductance-affecting capacity.

22. The electro-dynamic loudspeaker as defined in claim 21 wherein the inductance-affecting core is substantially flat.

23. The electro-dynamic loudspeaker of claim 20 wherein each inductor has a central axis, and the movement of the inductance-affecting core is in a direction that is orthogonal to the central axis of each inductor.

* * * * *